United States Patent [19]

Fortier et al.

[11] Patent Number: 4,810,559

[45] Date of Patent: Mar. 7, 1989

[54] FABRIC WITH WEAR AND ABRASION RESISTANT PLATELETS

[75] Inventors: Germain Fortier, Lac Megantic; Nicolas Kovacs, Montreal; Jean Laliberte, Neufchatel, all of Canada

[73] Assignee: Drospo Inc., Lac Drolet, Canada

[21] Appl. No.: 36,341

[22] Filed: Apr. 9, 1987

[51] Int. Cl.[4] ..... B32B 3/10; B32B 3/16; F41H 1/02

[52] U.S. Cl. ..... 428/161; 2/2; 2/2.5; 2/16; 2/20; 2/22; 2/23; 2/46; 2/51; 2/161 R; 2/161 A; 2/243 R; 2/272; 156/232; 156/242; 156/299; 156/302; 156/309.6; 264/257; 264/273; 264/279; 428/172; 428/196; 428/197; 428/198; 428/911; D29/10

[58] Field of Search ..... 428/911, 161, 198, 172, 428/196, 197; 2/2, 2.5, 16, 20, 22, 23, 46, 51, 161 R, 161 A, 243, 272; 156/232, 242, 299, 302, 309.6; 264/257, 273, 279

[56] References Cited

U.S. PATENT DOCUMENTS

| | | | |
|---|---|---|---|
| 921,352 | 5/1909 | Blaker et al. | 428/911 |
| 1,282,411 | 10/1918 | Golembiowski | 428/911 |
| 1,924,677 | 8/1933 | Cadgene | 428/137 |
| 2,569,398 | 9/1951 | Burd et al. | 428/78 |
| 2,723,214 | 11/1955 | Meyer | 428/911 |
| 3,722,355 | 3/1973 | King . | |
| 3,746,602 | 7/1973 | Caroli et al. . | |
| 3,832,265 | 8/1974 | Denommee . | |
| 3,867,239 | 2/1975 | Alesi et al. | 428/911 |
| 4,249,302 | 2/1981 | Crepeau | 428/138 |
| 4,493,865 | 1/1985 | Kuhlmann et al. | 2/167 |

FOREIGN PATENT DOCUMENTS

| | | |
|---|---|---|
| 892301 | 2/1972 | Canada . |

*Primary Examiner*—James C. Cannon

*Attorney, Agent, or Firm*—Robic, Robic & Associates

[57] ABSTRACT

A protective web for use in the manufacture of garments to reinforce parts of the garments corresponding to parts of the human body most likely to be exposed to scratching or fleshing of the skin or muscles. This web is characterized in that it comprises a piece of fabric that may be a woven, knitted or non-woven textile or yet be made of synthetic material. A plurality of small rigid platelets capable of resisting wear and abrasion are secured over this piece of fabric. The small platelets are so uniformly distributed and spaced over the piece of fabric as to allow the web to yield under all movements of the body of the garment wearer. According to a preferred embodiment, the rigid platelets are made of polymeric thermoplastic or thermosetting material and are secured to the fabric by gluing, compression molding or yet by welding in the case where the fabric used is made of synthetic material.

13 Claims, 2 Drawing Sheets

FABRIC WITH WEAR AND ABRASION RESISTANT PLATELETS

BACKGROUND OF THE INVENTION

1. Field of the Invention

The present invention relates to a protective web intended to be used in the manufacture of garments for reinforcing parts thereof that correspond to parts of the human body most exposed to scratching or fleshing risks of the skin or of the muscles.

2. Description of the Related Art

As everyone knows, certain activities such as motorcycling, present great risks in the case of fall following an accident or skidding. Particularly at great speed, the falls may result in scratching as well as fleshing of the skin and of the muscles of the motorcyclist at places of his anatomy that are most exposed, namely the elbows, the shoulders, the hips or the knees.

SUMMARY OF THE INVENTION

The protective web which is the object of the present invention is intended to be used either, as such, as an external component or as a cover of a garment, or in the form of a lining integrated to the structure of a garment such as a pair of trousers or a jacket of a motorcyclist, to protect the most exposed parts of the body of the garment wearer against the risks of mechanical abrasion capable of leading to scratching or to fleshing.

The protective web according to the invention is characterized in that it comprises a piece of fabric that can be a weaved, knitted or unweaved textile or yet a synthetic fabric. A plurality of small rigid platelets capable of resisting wear and abrasion are secured over this piece of fabric. These small platelets are so distributed and spaced on the piece of fabric as to allow the web to yield under all movements of the body, of the garment wearer.

According to a preferred embodiment of the invention, the small rigid platelets are made of polymeric thermoplastic or thermosetting material and are secured to the piece of fabric by gluing, compression molding or yet by welding in the case where the piece of fabric used is a fabric made of synthetic material. The use of platelets made of thermoplastic or thermosetting material is advantageous with respect to the use of metal platelets as they make it possible to avoid, when the motorcyclist falls, the creation of sparks capable of igniting a pool of gasoline.

The invention as well as its various advantages will be better understood from the description that follows of various preferred embodiments, the description referring to the appended drawing wherein.

Figure 2:
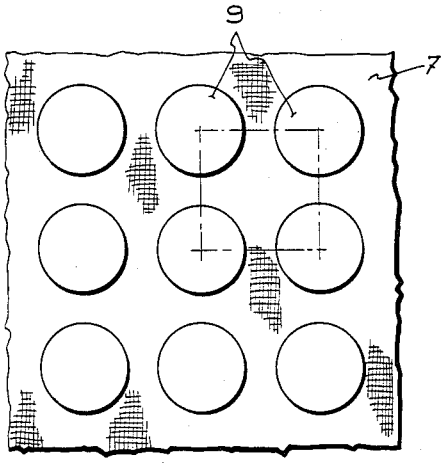
FIG. 2 is a plan view of a protective web made according to the invention and provided with platelets distributed according to a square and regular layout.
Figure 3A:
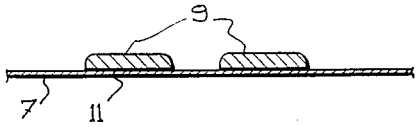
Figure 3B:
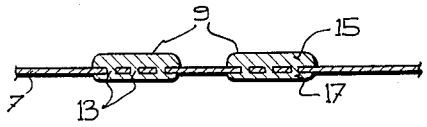
Figure 4:
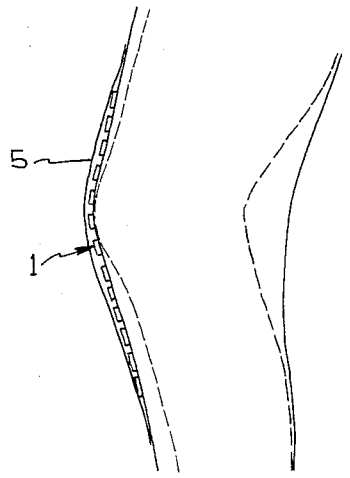
Figure 5:
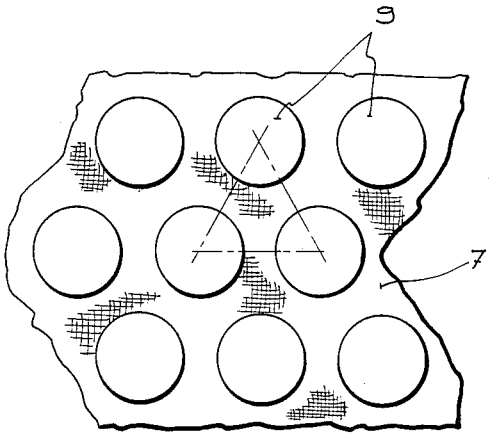

FIG. 3*a* is a side view of the web of FIG. 2 illustrating the platelets secured by gluing;

FIG. 3*b* is a view identical to that of FIG. 3*a* illustrating the platelets secured by compression molding;

FIG. 4 is a diagrammatic cross-sectional view of the knee of one leg of a pair of trousers incorporating a protective web made according to the invention and acting as a lining, and FIG. 5 is a plan view identical to that of FIG. 2 illustrating a protective web provided with rigid platelets distributed according to a triangular and regular layout.

As mentioned previously, the protective web according to the invention is especially intended for use in the making of garments to provide reinforcements for the parts of the garment corresponding to the parts of the body that are most exposed to scratching and fleshing risks.

Figure 1:
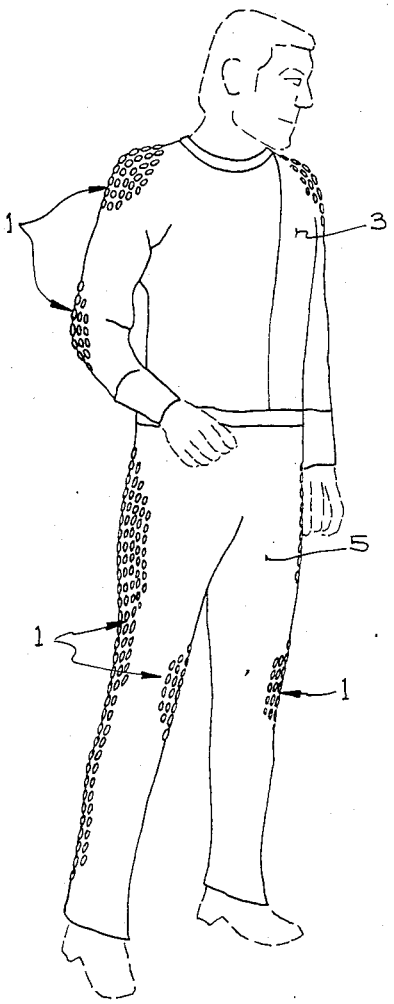
FIG. 1 illustrates a motorcyclist provided with a pair of trousers and with a jacket of which certain parts are outwardly covered with a protective web made according to the invention.

As shown in FIG. 1, the protective web 1 may be used as an outer component or as a cover at the level of the surface of the elbows and of the shoulders of a jacket or of an over-garment 3 as well as at the level of the surface of the knees or hips of a pair of trousers 5 worn by a motorcyclist. It will however be understood that this web may be used in the manufacture of garments intended for any other type of activities where a certain form of protection must be provided at the level of certain parts of the body of the wearer. Thus, the protective web 1 will be useable in the manufacture of professional garments, garments for leisure, for the military, for rescue work, that is garments for any activity where a certain protection is to be ensured. This protective web will likewise be useable to protect animals as well as objects exposed to the same danger, that is to the danger of wear by mechanical abrasion.

FIG. 4 shows that the protective web 1, according to the invention, may not only be used for covering but likewise as a lining or insert.

Referring now to FIGS. 2, 3 and 5, the protective web comprises a piece of fabric 7 over which are secured a plurality of small rigid platelets 9 made of a material highly resistant to wear and to abrasion.

The platelets 9 may have any external form but are preferably circular with a slightly convex upper surface and with free edges that are rounded to prevent them from being hooked onto a rough surface. The platelets 9 are distributed and spaced preferably uniformly over the piece of fabric 7 to allow it to follow or yield to every movement of the body of the garment wearer.

By way of example, the circular platelets 9 may have a diameter in the order of 12 mm and may be spaced from one another a center-to-center of about 15 mm. In order not to unduly thicken the garment, the thickness of the platelets may be selected to be of about 3 mm.

FIG. 2 illustrates that the rigid platelets 9 may be distributed according to a square and regular layout. FIG. 5 shows that the platelets 9 may likewise be distributed according to a triangular and regular layout. It is proper however to mention that in no case is it necessary that the platelets be regularly spread provided that they furnish the required protection while ensuring that the piece of fabric 7 remains flexible. In fact, the shape and size of the platelets are not by themselves essential provided that, there again, the shape and the size provide, on the one hand, the needed protection while giving the fabric the flexibility necessary to make it useable in the manufacture of garments.

As illustrated in FIG. 3*a*, the platelets 9 may be secured to the piece of fabric 7 by heat adhesion or by means of a glue 11.

FIG. 3*b* illustrates that the small rigid platelets 9 may likewise be secured to the piece of fabric 7 by compression molding, the latter technique implying the creation of bridges 13 extending across the fabric 7. If need be, the fabric may be provided with perforations at appropriate locations to ensure this bridging. In the latter case, each platelet once molded has a first portion 15 on one side of the piece of fabric 7 and a second portion 17 disposed on the other side of the piece of fabric 7, the said portions 17 and 15 may be connected together by the bridges 13 extending across the piece of fabric 7.

In the case where the piece of fabric used is of the synthetic type, the platelets 9 may also be secured by welding.

As previously mentioned, the rigid platelets 9 are preferably made of thermoplastic or thermosetting polymeric material. On the other hand, the piece of fabric 7 used may be of any type. It may, namely, be a woven fabric, a knitted one or a non-woven one, or a synthetic fabric. This fabric may also be constituted by a mere flexible film such as a sheet of polypropylene.

The platelets 9, the piece of fabric 7 which supports them or both may be colored or treated in such a way as to serve as visual warning in the case, of course, where the protective web is used as an outer component or as a cover over the garment structure. Thus, fluorescent colors or light reflecting platelets may be resorted to, this type of platelets being namely used in a context of road safety.

According to the invention, one will prefer using silica fillers because of their high resistance to wear by abrasion.

Other types of fillers may also be used such as calcium carbonates, talc powder, etc., to give the polymeric paste a consistence facilitating its process of use.

To make the platelets fireproof, one may likewise use fillers such as alumina trihydrate, $ZnBO_3$, $Sb_2O_3$ or halogenated, phosphonated or halogeno-phosphonated plasticisers such as FRYOLCEF (trade mark), or halogenated resins, or combinaison of the previously cited fireproof material. This fireproofing of the platelets will particularly be interesting in the case where use is made of aramide fiber fabrics or other similar fireproof materials. It will indeed be appreciated that the protective web will not only act as a mechanical protector but as well as a protector against burns.

Many examples of formulas that can be used in the making of platelets for a protective web made according to the invention are given in table I, hereinbelow. In this table, one will note the presence of catalyzers and promotors of known type of which the function is obviously to allow polymerization of the polymeric material with or without external addition of heat

TABLE 1

| COMPONENTS | 1 | 2 | 3 | 4 | 5 | 6 | 7 |
|---|---|---|---|---|---|---|---|
| Unsaturated polyester resins | | | | | | | |
| Reichhold 32-727 | 93.60 | | | | 52.62 | | |
| Reichhold CC-355 | | 38.60 | 33.00 | | | 9.30 | 71.80 |
| Reichhold IC-166 | | | | 46.00 | | | |
| FYROLCEF plasticizer | | | | | | | 11.80 |
| Methyl methacrylate monomer | | | | | | 3.10 | |
| Fillers | | | | | | | |
| Hydrogenates silicates | 4.40 | | | | 2.00 | | 4.70 |
| Silica powder | | 60.55 | | | 18.60 | | |
| Marble dust | | | 65.98 | | | | |
| Alumina tri-hydrate | | | | 52.88 | 15.35 | | 9.44 |
| CaCO | | | | | 10.00 | | |
| Silica sand (24–325 mesh) | | | | | | 87.40 | |
| Promoters | | | | | | | |
| Cobalt octoate (12%) | 0.93 | 0.40 | 0.60 | 0.60 | 0.80 | 0.02 | 1.18 |
| Di-methyl aniline | 0.07 | 0.02 | 0.02 | 0.02 | 0.03 | | 0.40 |
| Catalysts | | | | | | | |
| Methyl peroxyde ethyl ketone | 1.00 | 0.48 | 0.40 | 0.50 | 0.60 | 0.18 | 1.18 |
| TOTAL | 100.00 | 100.00 | 100.00 | 100.00 | 100.00 | 100.00 | 100.00 |

Where the platelets 9 are made of thermoplastic or thermosetting polymeric material, the thermoplastic or thermosetting resin may be used as a binder in proportions that may vary from 10 to 99%, the fillers, plasticizers, coloring pigments, etc . . . proportions from 1 to 90%.

Thermosetting resins of the saturated polyester, epoxy, polyurethane and acrylate types are to be preferred since they are usually far better heat-resistant than are thermoplastic resins. This heat-resistance is indeed an important advantage in the case of the present invention, considering the intensity of the heat that may develop by friction of the platelets with the ground which is often already hot at the time of an accident.

For purely economic reasons, the use of a vinylic monomer-based unsaturated polyester type of thermosetting resins is preferred.

The fillers incorporated in the resin may be sand, silica powder, marble dust, alumina trihydrate, calcium carbonate, hydrogenated silicates such as "Cab-O-Sil" (trade mark) or any other filler known and commonly used in paste, mortar or resin concrete.

The protective web according to the invention may be obtained by a continuous process or made in batches.

In the first case, the catalyzed polymer paste is mixed in a continuous manner by means of a machine for making polymer concrete or polymer paste of the type made or distributed by the RESPECTA and VENUS firms. The paste is poured in a mold through the orifices of a removable membrane setting up the desired platelets distribution. Then, the removable membrane is taken off from the mold, thus leaving some cavities filled with polymeric paste slightly in excess. The platelet-supporting piece of lining fabric is then applied over the paste thus placed in the mold, before its gelification. After a few minutes, when the catalyzed paste has started to polymerize, the lining fabric is pulled from the mold with the platelets adhering to it.

If the batch process is used, the required quantities of polymeric resin and promoters are mixed until a homogenous mixture is obtained by means of a mixer which can be manually or mechanically operated. The fillers are then inserted in the mixer and mixed to the resinous material until there is obtained a consistence which is like that of petroleum gelly or any other desirable consistence for the forming process.

Depending upon the quality of the resinous paste thus made and upon the need of the process with respect to the molding of the platelets or of the need of the protective linking web, a portion or all of the paste may be taken off for incorporation thereto of one or more catalyzers. The thus catalyzed paste is then mixed and immediately placed in the mold through the orifices of a removable membrane setting up the desired platelets distribution. The removable membrane is taken off from the mold, thus leaving some cavities filled with the polymeric paste slightly in excess. The platelet-supporting piece of lining fabric is then applied over the catalyzed paste before its gelification.

After a few minutes, when the catalyzed paste has started to polymerize, the protective lining is withdrawn from the mold with the platelets adhering to it.

We claim:

1. A protective web for use in the manufacture of a garment for reinforcing parts of said garment located where portions of the human body are most likely to be exposed to scratching or fleshing, said web comprising:

a piece of fabric made of synthetic material and a plurality of small rigid platelets welded on said synthetic material, wherein said platelets are made of a polymeric, thermoplastic or thermosetting material capable of resisting wear and mechanical abrasion and are so distributed and spaced on said piece of fabric as to allow said web to yield under all movements of the body of the garment wearers.

2. A protective web as claimed in claim 1, wherein each of said rigid platelets is circular, slightly convex and is formed with a rounded edge to prevent hooking thereof on a rough surface.

3. A protective web as claimed in claim 1, wherein said platelets are welded on said synthetic material by application of said synthetic material over the polymeric thermoplastic or thermosetting material before said polymeric material is gelified.

4. A protective web as claimed in claim 3, wherein each rigid platelet has a diameter of about 12 mm and is spaced from other like platelets a center-to-center distance of about 15 mm.

5. A protective web as claimed in claim 3, wherein said platelets are distributed according to a square and regular layout.

6. A protective web as claimed in claim 3, wherein said platelets are distributed according to a triangular and regular layout.

7. A safety garment comprising a protective web as defined in claim 3, wherein said protective web is a lining located at one of said garment parts and means integrating said web to said one of said garment parts.

8. A safety garment comprising a protective web as defined in claim 3, wherein said protective web is an outside component or outside cover located at one of said garment parts and means integrating said web to said one of said garment parts.

9. A protective web as claimed in claim 3, wherein:

said piece of fabric is selected from the group of fabrics consisting of woven fabrics; knitted fabrics; non-woven fabrics and fabrics made of synthetic material, and said polymeric material of which said platelets are made is a thermosetting resin selected from the group consisting of unsaturated polyester; epoxy; polyurethane and acrylic.

10. A protective web as claimed in claim 9, wherein said thermosetting resin is a mixture containing at least one filler selected from the group of fillers consisting of sand, silica powder, marble dust, talk powder, alumina trihydrate, calcium carbonate, hydrogenated silicates, $ZnBO_3$ and $Sb_2O_3$.

11. A safety garment comprising a protective web as defined in claim 9, wherein said protective web is a lining located at one of said garment parts and means integrating said web to said one of said garment parts.

12. A safety garment comprising a protective web as defined in claim 9, wherein said protective web is an outside component or outside cover located at one of said garment parts and means integrating said web to said one of said garment parts.

13. A protective web as claimed in claim 10, wherein said thermosetting resin comprises a halogenated, phosphonated or halogeno-phosphonated plasticizer.

* * * * *